US005363925A

United States Patent [19]

Gallagher

[11] Patent Number: 5,363,925

[45] Date of Patent: Nov. 15, 1994

[54] MOBILE DRILLING MACHINE

[76] Inventor: Alton V. Gallagher, 1576 S. Robb Way, Lakewood, Colo. 80232

[21] Appl. No.: 15,645

[22] Filed: Feb. 9, 1993

[51] Int. Cl.[5] ..... E21C 11/02

[52] U.S. Cl. ..... 173/186; 173/185; 173/189; 173/28

[58] Field of Search ..... 173/28, 184, 185, 213, 173/39, 27, 140, 186, 187, 189; 175/162, 122

[56] References Cited

U.S. PATENT DOCUMENTS

| | | | |
|---|---|---|---|
| 2,418,601 | 4/1947 | Richards | 173/28 |
| 2,856,155 | 10/1958 | Putt | 173/184 |
| 3,817,334 | 6/1974 | Bolt | 173/187 |
| 3,917,005 | 11/1975 | Cannon et al. | 173/189 |
| 4,181,182 | 1/1980 | Gustafsson | 173/189 |
| 5,033,554 | 7/1991 | Younes | 175/162 |
| 5,090,486 | 2/1992 | Jones | 173/28 |

*Primary Examiner*—Eugenia Jones
*Assistant Examiner*—Allan M. Schrock
*Attorney, Agent, or Firm*—W. J. Scherback

[57] ABSTRACT

A mobile drilling machine adapted to be mounted on an all-terrain vehicle of the type principally utilized for recreational purposes. Secured to a reinforced rear luggage rack of the vehicle is an equipment supporting plate carrying a drill beam mounted thereto by way of a support bearing. The drill beam is rotatable from a horizontal traveling position to vertical drilling position. The drill beam has, at its lower end, a base plate which is attached to a hydraulic cylinder. At a drill site, the hydraulic cylinder is actuated to lower the base plate to the ground surface. Continued movement of the cylinder lifts the rear end of the vehicle which places a portion of the weight of the vehicle on the drill beam to maintain the position of the drill beam.

6 Claims, 4 Drawing Sheets

MOBILE DRILLING MACHINE

BACKGROUND OF THE INVENTION

1. Field of the Invention

This invention relates to drilling machines and more particularly to improved mobile drilling machine adapted to be mounted on the frame of an all-terrain vehicle or on the bed of a pickup truck.

2. Discussion of the Prior Art

The prior art is replete with drilling machines of varying designs. Present day mobile drilling machines are expensive, cumbersome, and in some cases require specially designed carriers. For example, U.S. Pat. No. 3,917,005 describes a mobile drilling machine for a specially designed carrier, and while it is professed to be compact and highly maneuverable, it is in fact, quite complex, expensive and requires the specially designed carrier. It is indeed too expensive and cumbersome for carrying out such drilling tasks as holes for fence posts, environmental soil samples, and seismic shot holes.

U.S. Pat. No. 4,303,130 is another example of a mobile drilling system having limited utility because of the requirement of a special carrier, including such features as hydraulic drive units to propel the carrier. Set up and take down times are excessive and there are many areas which, because of the machine, would be inaccessible.

SUMMARY OF THE INVENTION

As compared with conventional units, a mobile drill machine in accordance with the present invention has the advantages of being capable to drill at angles other than vertical, of being exceptionally simple to operate, of being highly maneuverable and of design to drill or make holes in areas inaccessible to drill machines of the prior art. Particularly, the drilling machine of the present invention is designed to be carried on a mobile steerable support vehicle which may be a standard pickup truck, but preferably, an all-terrain vehicle commonly used today for recreational purposes, being of light weight and highly maneuverable. As such, the drilling machine may rapidly be carried across rough terrain and is ideally suited for drilling fence post holes, obtaining environmental soil samples, and drilling seismic shot holes, with minimal environmental damage and in areas unaccessible to large truck or tractor mounted drilling systems.

The drilling machine itself is comprised of a drill beam, pivotally mounted at one end of the support vehicle at a point intermediate the ends of the drill beam. A drill motor carriage is slidably mounted on the drill beam. Means is provided for lowering one extremity of the drill beam into contact with an earth surface to raise the one end of the support vehicle to apply a portion of it's weight to the drill beam and to lock it in position relative to the earth's surface during drilling operations and also to isolate the support vehicle from the effects of drilling operations. Utilizing the drill beam and the weight of the support vehicle to hold the drilling machine in position is in contrast to the complex and expensive devices utilized in the prior art where a drilling machine is held in position by hydraulic cylinders mounted on the front and back or sides of the carrier frame with suitable stabilizing shoes for the purpose of stabilizing the vehicle during a drilling operation.

The drill beam is moveable at the pivotal mounting from a horizontal position utilized when traveling from one drill location to another to a vertical position for conducting drilling operations.

Chain sprockets are mounted on the drill beam adjacent extremities thereof and a drive chain positioned over the sprockets and connected to the drill head for reciprocating the same on the drill beam. A reversible hydraulic motor is mounted on and near the lower extremity of the drill beam and connected to the drive chain for imparting movement to the chain.

Where the mobile support vehicle is provided with a towing connector, such as a tow bar, the drill beam is located on the vehicle to one side of the connector to permit connection to a trailer to be towed by the vehicle between drill-hole sites. This permits carrying of supplies such as fence posts and related materials from one site to another site without requiring an auxiliary vehicle.

It is an object of the present invention to provide a light weight, heavy duty drilling system to be mounted on and carried by a commercially available vehicle.

These and other features of the present invention will become apparent in view of the following written description when taken in view of the accompanying drawing.

DETAILED DESCRIPTION

Figure 1:
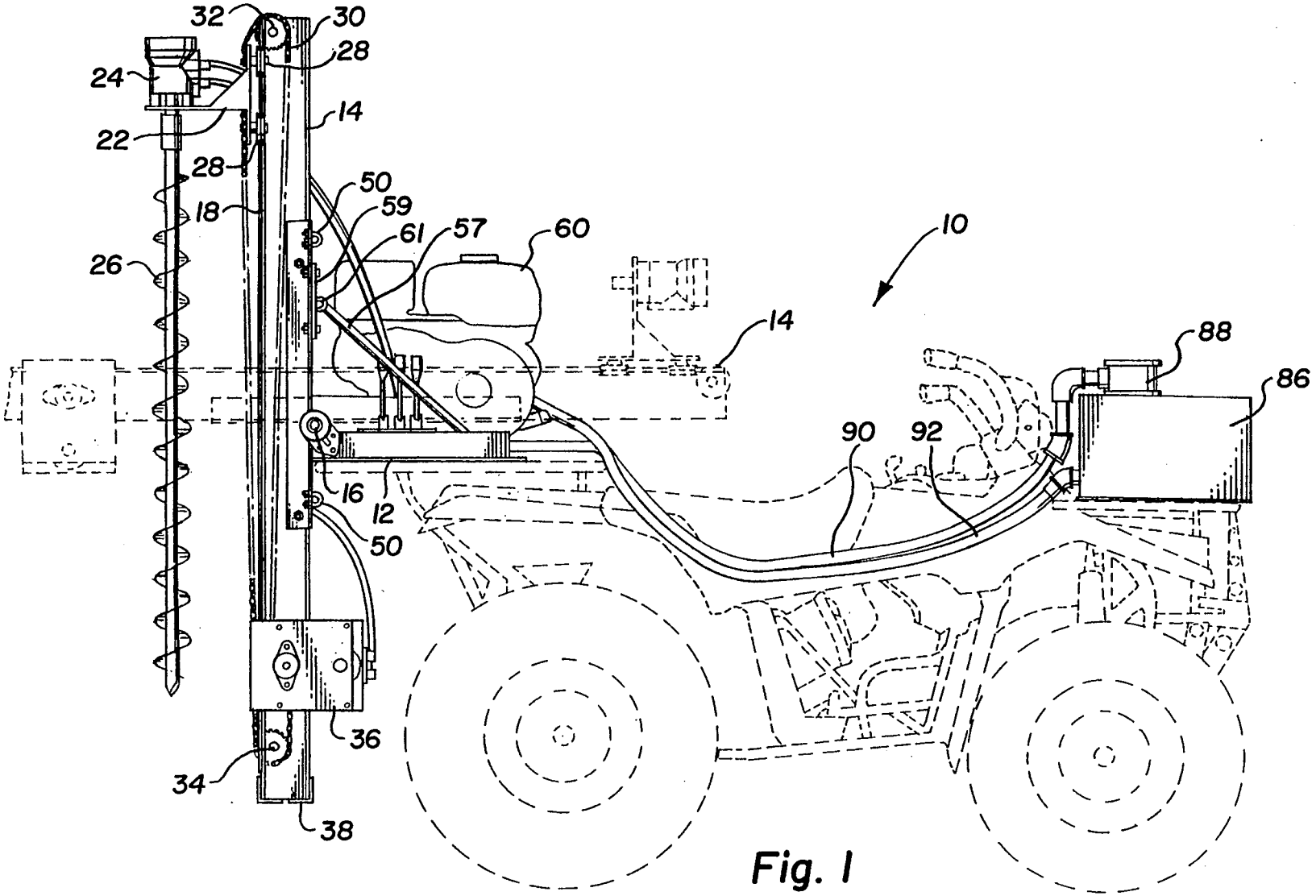
FIG. 1 is a side elevation view of the mobile drilling machine of the present invention, illustrating alternate positions of the drill beam for drilling and in transit.
Figure 2:
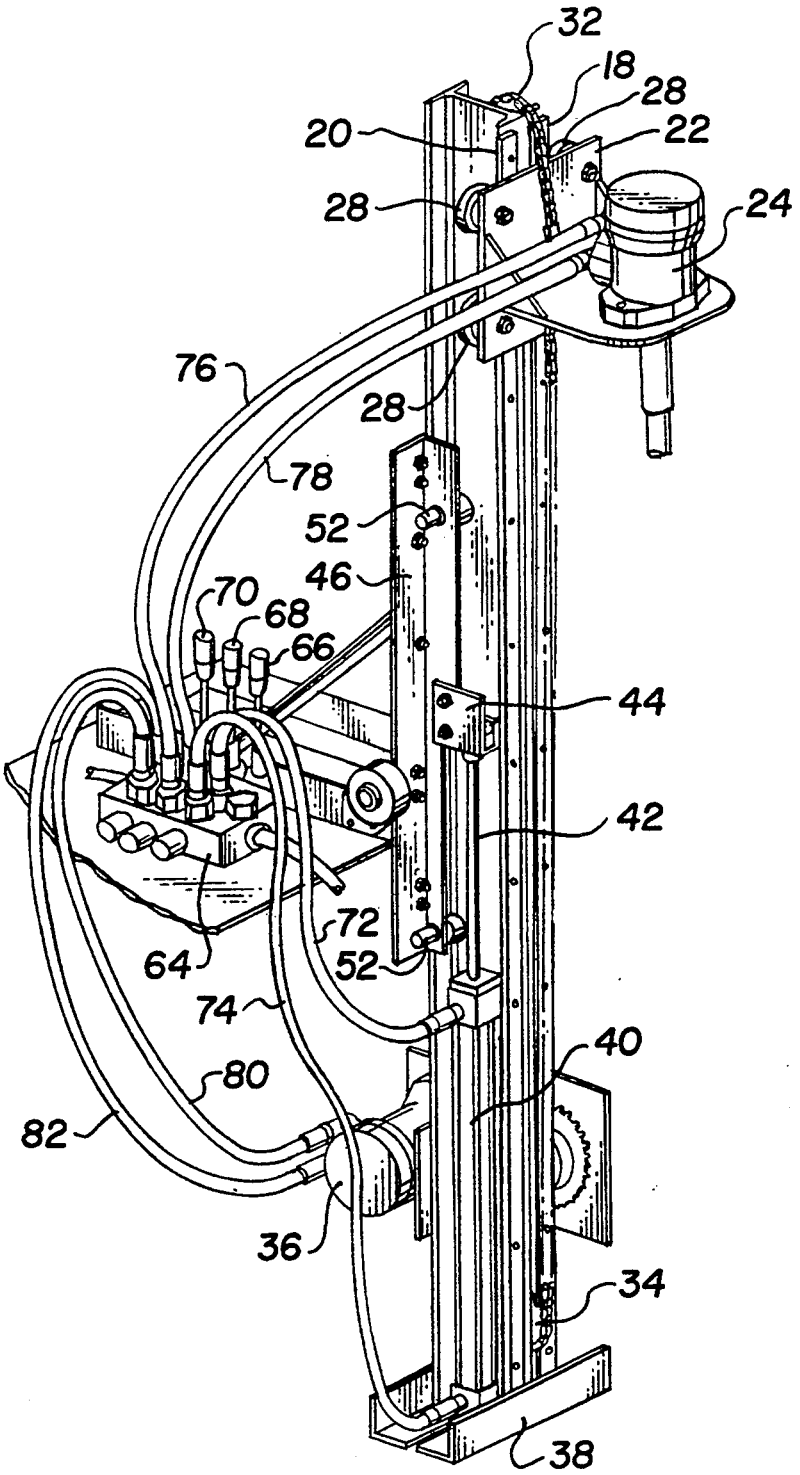
FIG. 2 is a perspective view of the drill beam illustrating a hydraulic motor for driving an auger, a hydraulic motor for raising and lowering the auger motor, and the various hydraulic hose or line connections.

The present invention in a mobile drilling machine is shown in the drawing in FIG. 1 in connection with a mobile steerable support vehicle shown in phantom and indicated generally at 10. While the support vehicle 10 may take on various commercially available forms and designs, including that of a pickup truck, it is preferred to utilize an all-terrain vehicle as shown, which vehicle is of the type used principally for recreational purposes, being of light weight and highly maneuverable.

Secured on a reinforced rear luggage rack of the vehicle 10 is a platform or plate 12. A drill beam 14 is connected to the plate 12 by way of a support bearing 16. The support bearing 16 permits the beam 14 to be rotated from a vertical drilling position to a horizontal position, shown in phantom, for travel to provide a low profile for traveling through trees and underbrush. The horizontal traveling position also provides a low center of gravity for stability. In the horizontal traveling position the lower portion of the drill beam projects from the rear of the vehicle eliminating, to a large degree, the possibility of the vehicle flipping over backwards when negotiating steep terrain.

Drill beam 14 is a conventional light weight I-beam, rear flanges on which are secured side bars or tracks 18 and 20 for guiding the vertical movement of a traveling carriage 22 which supports a bi-directional hydraulic motor 24 to turn the auger or drill 26. Guide wheels 28 mounted to the carriage 22 engage the tracts 18 and 20 for rolling movement along the tracks in a vertical direction. The carriage 22 and the hydraulic motor 24 are raised and lowered by way of a chain 30 passing over upper and lower chain sprockets 32 and 34 and driven by a hydraulic motor drive chain hoist 36. Hydraulic hoist chain motor is positioned below the drill beam support bearing 16 to counterbalance the weight of the hydraulic drive motor 24 and thus ease the positioning of the drill beam from a horizontal position to a vertical position and vice-verse.

The drill beam 14 is provided, at its lower end, with a base support or plate 38 attached to the lower end of a hydraulic cylinder 40. The hydraulic cylinder 40 is fastened to the drill beam and the hydraulic cylinder actuating rod 42 is fastened by a bracket 44 to an angle bracket 46. Angle bracket 46 is connected to the support bearing 16 which transfers a portion of the weight of the vehicle to the drill beam when the hydraulic cylinder 40 is actuated. When a drill site has been reached, the hydraulic cylinder 40 is energized to move the base support 38 down to engage the ground surface and continued movement of the cylinder in a downward direction lifts the rear end of the vehicle to place a portion of the weight of the vehicle on the drill beam to assist in maintaining the drill beam 14 in place on the ground.

With a portion of the weight of the vehicle placed on the drill beam, auger or drill string 26 will remain in line with the hole being drilled in those situations where the soils being drilled tend to pull the auger or drill string 26 into the hole.

Angle brackets 46 and 48 are fixed to the support bearing 16 and carry drill beam vertical travel bearings along which the drill beam 14 will move vertically as the hydraulic cylinder 40 drives the plate 38 into and out of engagement with the surface of the ground. More particularly, the travel bearings include back travel bearings 50 and a front travel bearings 52. The back vertical travel bearings 50 are secured to the brackets 46, 48 by way of U-shaped clamps 51 bolted to the brackets. The bearings 50 engage a rear surface 54 of the T-beam forming the drill beam 14 and the front travel bearings 52 each are in contact with an inner surface of the I-beam opposite the aforesaid outer surface 54. The arrangement of travel bearings 50 and 52 afford a stable engagement for movement of the drill beam 14 when the base plate 38 is raised and lowered into and out of contact with the ground surface.

The bearing arrangement as described, and particularly the drill beam support bearing 16, permits the drill beam and attached structure to lay flat for travel or to be adjusted at different angles of inclination other than vertical, when drilling is conducted on a sloping surface to assure the production of a vertical hole.

Figure 3:
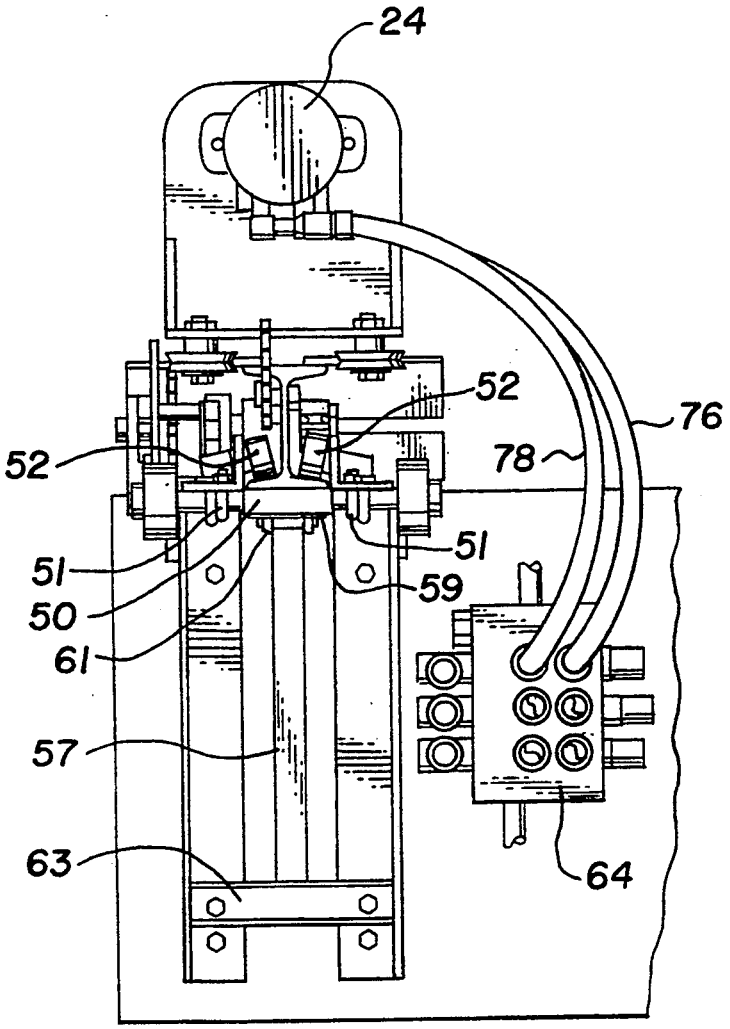
FIG. 3 is a top view of the drill beam and of the control console for operating the drilling machine, and FIG. 4 a rear view illustrating the drill beam mounted to the all-terrain vehicle, one side of center, to enable connection between the vehicle and a trailer for hauling supplies.

Upon arrival at a drill-hole site, the drill beam is set in a vertical position or in an inclined position, depending upon the inclination of the ground at the site and a kick-back brace 57 is connected to hold the drill beam in its set position. One end of the brace 57 is connected to a base support plate 59 which is fastened to angle brackets 46 and 48 and an opposite end rests against an adjustable brace stop 63 (FIG. 3).

Power to drive the various elements of the drilling system is provided by a prime mover 60, preferably a gasoline engine which drives a hydraulic pump 62. In one embodiment the hydraulic pump 62 provided 5 to 6 gallons per minute of hydraulic oil at a maximum of 2,000 pounds per square inch.

Application of hydraulic power is under control of a hydraulic valve console 64. Hydraulic pressure or power is selectively applied by way of the console 64 through the manipulation of control levers 66, 68, and 70. Lever 66 controls the application of hydraulic pressure via hoses 72 and 74 to the hydraulic piston 40. The lever 68 controls the application of hydraulic power via hoses 76 and 78 to the hydraulic drill motor 24 and the lever 70 controls the application of hydraulic pressure or power via hoses 80 and 82 to the hydraulic motor 36.

A hydraulic cooling reservoir 86 is mounted on a front rack of the all terrain vehicle 10 and includes a filter 88 mounted thereon. Flow of hydraulic fluid between the reservoir 86 and the pump 62 is conducted by way of hydraulic hoses 90 and 92. All the hydraulic hoses above described ar equipped with quick connect and disconnect fittings at their ends which permits the drill system to be quickly broken into individual packages 1.) the drill beam; 2.) the mounting plate with the hydraulic power source and controls; and 3.) the reservoir assembly.

Figure 4:
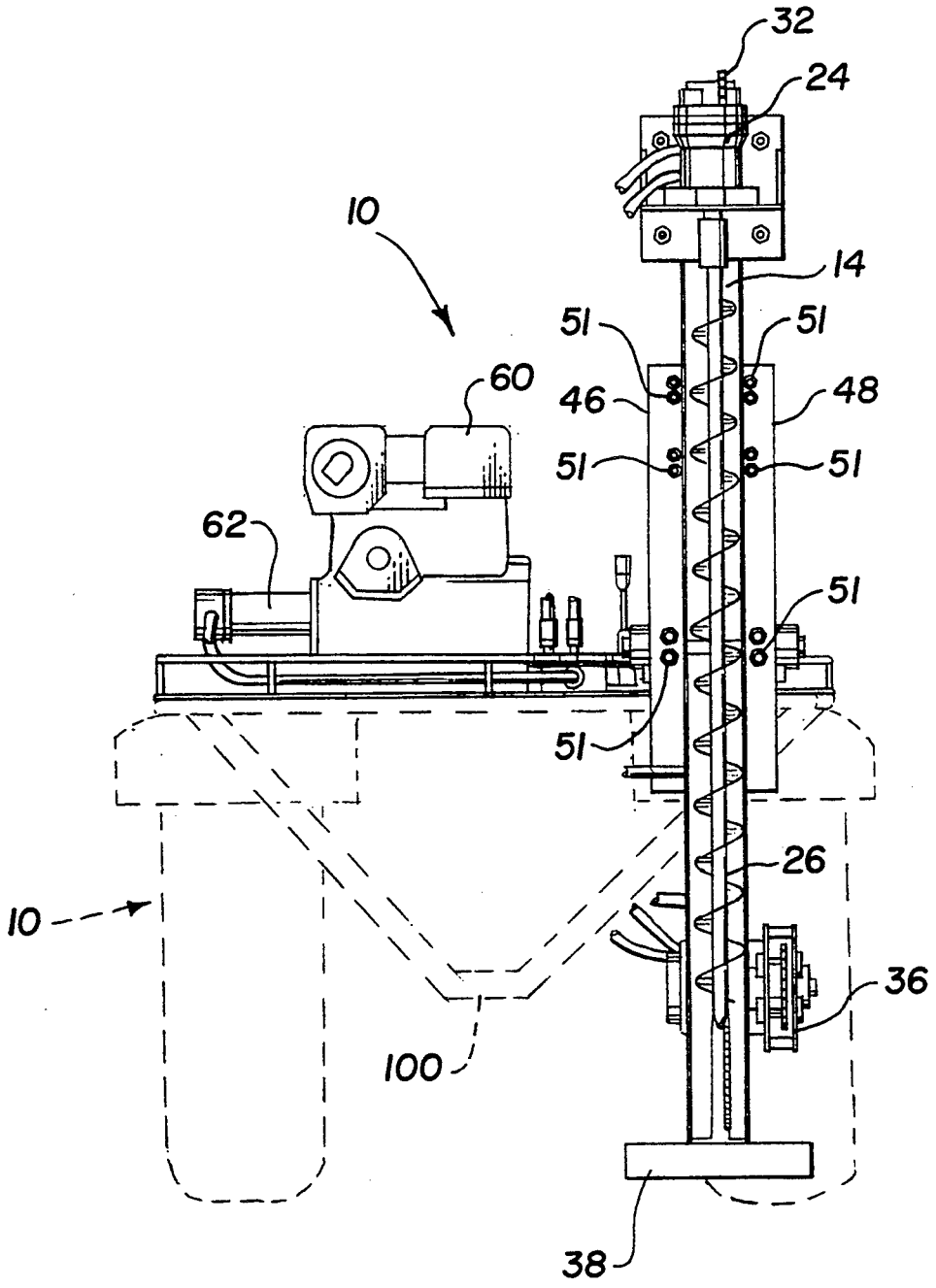

The drill beam 14 (FIG. 4) is mounted on the rear of the vehicle 10 and located off center. Mounting the drill beam off center avoids interference with the operation of the vehicle 10 when the drill beam is in a horizontal position for travel to drill-hole sites. In addition, the off center location of the drill beam permits a trailer (not shown) to be connected to a tow bar 100, shown in phantom, at the rear of the vehicle. Such an arrangement avoids the need of a second vehicle to carry supplies, i.e. fence posts, to drill-hole sites.

Now that the invention has been described, certain qualifications will occur to those skilled in the art and that is intended to cover such modifications as fall within the scope to the appended claims.

What is claimed is:

1. A portable mobile drilling machine comprising a mobile steerable support vehicle, a drill and a drill beam, means for pivotally mounting said drill beam on an end of said vehicle at a pivot point intermediate opposite ends of said drill beam to enable the manual rotation of said drill beam from a horizontal orientation to a vertical orientation means for slidably mounting the drill beam relative to the pivot point, a hydraulic reservoir mounted at a front end of said vehicle to counter balance the weight of said drill beam, a bi-directional hydraulic motor, a carriage supporting said motor, said carriage being slidably mounted on said drill beam, chain sprockets mounted on said drill beam adjacent the ends thereof, a drive chain positioned over said sprockets and connected to said carriage for reciprocating the same on said drill beam, a reversible hydraulic motor mounted on a lower end of said drill beam to provide balance for the easy manual rotation of the drill beam from a horizontal orientation to a vertical orientation and connected to said drive chain for imparting movement to said chain, and means for lowering said drill beam into contact with an earth surface to raise an end of said vehicle to apply a portion of the weight of said vehicle to said drill beam and lock it in position relative to the earth surface during drilling operations and to isolate said vehicle from pull down effects of soil upon the drill during drilling operations.

2. A portable mobile drilling machine comprising a mobile steerable support vehicle, drill and a drill beam, means for pivotally mounting said drill beam on an end of said support vehicle at a pivot point intermediate opposite ends of said drill beam to enable the manual rotation of said drill beam from a horizontal orientation to a vertical orientation means for slidably mounting the drill beam relative to the pivot point, a bi-directional hydraulic motor, a carriage supporting said motor, said carriage being slidably mounted on said drill beam, means for lowering an end of said drill beam into contact with an earth surface to raise an end of said vehicle to apply a portion of the weight of said vehicle to said drill beam and lock it in position relative to the earth surface during drilling operations and to isolate said vehicle from pull down effects of soil upon the drill during drilling operations, said means for lowering said end of said drill beam including a base plate at the lowered end of said drill beam and a hydraulic piston connected to said base plate for raising and lowering the drill beam.

3. A portable drilling machine to be carried on a mobile steerable support vehicle, comprising, a drill and a light weight drill beam manually moveable from a horizontal travel position to an approximate vertical position for drilling, means for pivotally mounting said drill beam on one end of the vehicle at a pivot point intermediate opposite ends of the beam to permit said manual movement, means for slidably mounting the drill beam relative to the pivot point a bi-directional hydraulic motor for rotating a drill, a carriage supporting said motor, said carriage being slidably mounted on said drill beam for vertical movement therealong, a base fixed at a bottom of said drill beam, and a hydraulic cylinder having an end connected to said base and including a piston rod mechanically mounted to said means for pivotally mounting said drill beam whereupon actuation of said hydraulic cylinder will lower said base to contact the earth's surface and place a portion of the weight of the vehicle upon said drill beam.

4. The drilling machine of claim 3 in which said steerable support vehicle is an all-terrain vehicle (ATV).

5. The drilling machine of claim 4 including a hydraulic reservoir mounted at a front end of said all-terrain Vehicle to counter balance the weight of said drill beam.

6. The drilling machine of claim 4 in which said all-terrain vehicle includes a centrally located tow bar and said drill beam is located to one side of said bar to permit connection of said vehicle to a trailer for towing by said vehicle between drill-hole sites while maintaining full operability of said drill beam.

* * * * *